United States Patent [19]

Godefroy

[11] 4,328,117

[45] May 4, 1982

[54] PROCESS OF OPACIFICATION OF A GASEOUS MEDIUM IN THE OPTICAL AND INFRARED BANDS OF THE ELECTROMAGNETIC SPECTRUM

[75] Inventor: Pierre Godefroy, Paris, France

[73] Assignee: Thomson-Brandt, Paris, France

[21] Appl. No.: 151,590

[22] Filed: May 20, 1980

[30] Foreign Application Priority Data

May 23, 1979 [FR] France ..... 79 13195

[51] Int. Cl.[3] ..... C09K 3/30; C09K 9/00

[52] U.S. Cl. ..... 252/305; 149/117

[58] Field of Search ..... 252/359 R, 359 A, 359 CG, 252/305, 314, 317, 350; 102/90; 149/117

[56] References Cited

U.S. PATENT DOCUMENTS

| | | | |
|---|---|---|---|
| 2,839,567 | 5/1958 | Reure et al. | 252/359 CG |
| 2,995,526 | 8/1961 | DeMent | 252/305 |
| 3,239,960 | 3/1966 | Stevens | 252/359 CG |
| 3,244,641 | 4/1966 | Durr et al. | 252/359 CG |
| 3,992,628 | 11/1976 | Karney . | |
| 4,100,102 | 7/1978 | Shaffer | 252/305 |

OTHER PUBLICATIONS

Kirk-Othmer; vol. 4; pp. 131 & 132; copyright 1978.

*Primary Examiner*—Bradley Garris
*Attorney, Agent, or Firm*—Oblon, Fisher, Spivak, McClelland & Maier

[57] ABSTRACT

The invention relates to a process for opacifying a gaseous medium transparent to optical and thermal radiation.

It is characterized in that it consists in diffusing in the medium, for example the atmosphere, an aerosol such as boron trichloride ($BCl_3$).

The invention applies to the field of electro-optical countermeasures.

7 Claims, No Drawings

PROCESS OF OPACIFICATION OF A GASEOUS MEDIUM IN THE OPTICAL AND INFRARED BANDS OF THE ELECTROMAGNETIC SPECTRUM

BACKGROUND OF THE INVENTION

The invention relates to a process for making opaque (or opacification of) a gaseous medium in the optical and infrared (IR) bands of the electromagnetic wave spectrum; it relates also to the application of this process to an electro-optical counter-measure device. Some modern weapons systems are particularly efficient against relatively sensitive objects such as tanks, aircrafts, ships, shelters, etc . . . These weapons systems use projectiles or missiles equipped with electrooptical guidance or homing means which use the energy from the thermal or optical radiation coming from the object aimed at, still called a target in what follows. These radiations of an electromagnetic nature are: either emitted directly by the target itself, and more precisely by its propulsion system, or they result indirectly from the scattering by the target of natural illumination or even of an intentional illumination.

Other weapon systems are electro-optical sighting devices for detecting and locating a target by its natural radiation situated in the IR band (8 to 13 $\mu$m), for example, this location of the target permitting the firing of arms of the ballistic or guided type to be triggered off.

To counter the menace formed by electro-optical arms systems, different processes or means capable of deceiving the sighting, measuring and guiding devices of these arms systems are already known and are classified in two counter-measure techniques, one called "active" and the other "passive". According to the active counter-measure technique, electromagnetic radiation situated in the operating band of the weapon system is intentionally emitted, with the purpose particularly of blinding, jamming, or decoying the system. According to the passive counter-measure technique, the end in view is to create a reflecting and/or absorbing medium so as to provide generally in the form of a cloud a protective screen behind which the target to be detected may remain or move; according to the passive technique, the use must also be mentioned, on board the target, of specific means for reducing the radiation level emitted particularly by the propulsion unit or any other heat source.

In the prior technique relating to passive countermeasures, processes have already been proposed for creating "clouds" formed from extremely fine particles. For example, the process has been used of expansion by gas diffusion to create clouds formed from metal microparticles, with specific shapes and sizes having the property of reflecting or scattering incident electromagnetic radiation. Along other lines, attempts have been made to create clouds formed from non-metal particles, with specific shapes and dimensions, these having the property of absorbing the incident electromagnetic radiation.

SUMMARY OF THE INVENTION

The Applicant has undertaken researches to find new bodies which could produce screens opaque to optical and thermal radiation. During these researches, the Applicant has discovered that, when a liquid or gaseous aerosol such as boron chloride ($BCl_3$) is dispersed in the atmosphere there is produced a "cloud" which has the property of considerably attenuating the optical and IR radiation. During tests carried out by the Applicant, the absorption power of the new product thus created was measured and different means for diffusing $BCl_3$ in the atmosphere have been tested and perfected. It will be recalled that boron trichloride is an industrially obtained product and is commercially available; at atmospheric pressure, it is in the liquid condition, between $-107°$ C. and 12.5° C., its density being located substantially at the value 1.4. Different means for diffusing $BCl_3$ have been produced, particularly means for continuously diffusing $BCl_3$ in the atmosphere, with the purpose of maintaining the absorbing cloud thus formed and means for creating substantially instantaneously an absorbing cloud whose lifetime is more limited. During tests, it was discovered that an increase in the percentage of humidity in the atmosphere had a tendency to increase the value of the attenuation factor of the cloud. It is assumed that the boron trichloride diffused in the atmosphere is hydrolized by the water vapor in suspension, in accordance with the formula.

$$BCl_3+3H_2O \rightarrow B(OH)_3+3HCl$$

The invention also proposes means for dispersing conjointly in the atmosphere boron trichloride and water stored separately in one or more receptacles.

Other characteristics and advantages provided by the invention will appear in the following description which gives furthermore some applications of the invention to electro-optical counter-measures.

DESCRIPTION OF THE PREFERRED EMBODIMENT

There will be described first of all the conditions for carrying out tests in the field and at ground level with the purpose of checking, on a life-size scale, the properties and characteristics of the absorbing cloud formed by the dispersion of a certain quantity of $BCl_3$ in the ambient atmosphere.

At a point A of the terrain there was placed an optical source formed by a laser illuminator, operating under pulsating conditions at a wavelength $\lambda=1.06$ $\mu$m, this laser illuminator being aimed at a target situated at a point B distant from point A. Near point A measuring equipment was placed for detecting, processing and displaying the echo signals back-scattered by the propagation medium (atmosphere) and the target. During the initial phase of these tests, the principal parameters such as the level power radiated by the laser illuminator, the sensitivity of the measuring equipment, were adjusted so as to obtain a target echo whose signal/noise ratio is high. Then a receptacle containing $BCl_3$ was placed between points A and B of the terrain. As soon as the orifice of this receptacle was opened, complete black out of the echo signal corresponding to the target was noted but, on the other hand, there was noted the presence of plurality of echo signals back-scattered by the medium formed by the absorbing cloud resulting from the diffusion of $BCl_3$. The results of these tests show that the absorbing cloud is not homogeneous and is also the seat of concentrations which develop with time.

Other series of tests were carried out with a view to quantitatively evaluating the attenuation factor of such clouds formed by the diffusion of $BCl_3$ in the ambient atmosphere. For this, radiation sources were used capable of emitting in different bands of the electro-magnetic spectrum, and a selective radiometer; the sources and the radiometer being situated on each side of the cloud. Accurate quantitative measurements proved delicate because of the fluctuating character of the atmosphere. However, it can be indicated that, for a delivery rate of $BCl_3$ of the order of 4 g per second within the range of the electromagnetic spectrum extending from 0.4 to 15 $\mu$m, the measured attenuation was always greater than 90%.

The implementation of the process consisting in dispersing the aerosol in the propagation medium depends on the operational conditions met with. In the simplest case, corresponding to a situation in which the target to be protected is fixed or immobile, a container is set down in which the aerosol is stored in liquid or gaseous form, this container comprising a diffusion nozzle equipped with an opening means which may be actuated manually or automatically at a remotely distance, for example, under the action of a signal supplied by an alert receiver.

In another case, the receptacle containing the aerosol is launched by the target itself or by a manned means; the receptacle then forms a projectile whose active charge is the aerosol; this projectile is equipped for example with a proximity or impact time fuse for triggering an appropriate pyrotechnic or mechanical device which causes the aerosol to be released at the chosen point in the atmosphere and its subsequent diffusion.

According to another mode of implementation, the aerosol is contained in a bomb fitted with a braking parachute and an opening means.

So as to increase the attenuation factor of the cloud created by the dispersion of $BCl_3$ in the atmosphere, means may possibly be used for dispersing conjointly the aerosol and water.

A device for simultaneously diffusing the aerosol and water comprises essentially the following elements: a first reservoir containing the aerosol in liquid or gaseous form and a second reservoir containing water, each reservoir is fitted with a pipe having an opening valve, the outputs of these pipes are connected to a common diffuser. So as to ensure the ejection of the water contained in the second reservoir, this latter is maintained under pressure by means of an auxiliary reservoir containing pressurized or pyrotechnically pressurized gas. When the temperature conditions are such that the temperature of the aerosol is below its vaporization temperature, the pressure supplied by the auxiliary gas reservoir may possibly be applied to the first reservoir containing the aerosol.

According to another mode of implementation of the process for dispersing the aerosol and water, these two products are contained in two compartments of a single receptacle and means, for example pyrotechnic means, ensure the breaking of the compartments and the joint release of the two products and their dispersion under the effect of the heat flow resulting from the operation of the pyrotechnic charge.

There will now be described an application of the process to the black-out of the exhaust nozzle of a propulsion system for an aircraft or a missile. It is known that the nozzle of a propulsion unit and the gas jet which escapes therefrom are a source of radiation whose energy is used by the electro-optical homing means of tactical missiles. If there is disposed on the periphery of the nozzle of the propulsion unit one or a plurality of diffusers supplied from a source of boron trichloride, there is produced at the outlet of this nozzle a medium capable of attenuating very appreciably the heat radiation of the propulsion unit. The flow rate from the source of boron trichloride may be controlled by an alert detector which detects the approach of an offensive tactical missile, by means of a program or manually by the pilot.

Of course, the present invention is not limited to the embodiments described by way of illustration; for example, the relative position of the two products, the aerosol and the water, may be interchanged.

The process may be used conjointly with active means such as emissive decoys. Furthermore, it is possible to dispose a plurality of $BCl_3$ dispersion devices so as to screen an infantry, armored vehicle unit, etc . . . wishing to move over the terrain, from the "view" of the adversary.

The advantages brought by the invention now appear more clearly: the implementation of the process raises no special difficulties, boron trichloride is a storable product, its vapor pressure does not reach high values in the range of temperatures usually met with. A specific characteristic of the $BCl_3$ cloud may be again recalled; as was pointed out during the description, the inhomogeneities of the absorbing medium give rise to back-scattering signals which are capable of decoying the electrooptical guidance means of the active or semi-active type. The process also presents the advantage of allowing a large range of lifetime of the cloud to be obtained, by acting on the dispersion means of the product(s).

The invention finds its application in an electro-optical countermeasure device comprising boron trichloride diffusion means alone or simultaneously with water; these substances may be contained in separate receptacles or in sealed compartments of a single receptacle such as the inside of a projectile. The release of the boron trichloride and, possibly, water if necessary, may be provided by pyrotechnical means disposed at the end of the receptacles. In a device for reducing the power of the heat radiation emitted by a propulsion unit, the diffusion means may be formed by diffusers disposed in the vicinity of the jet nozzle of this propulsion unit.

An electro-optical counter-measure device using the process of opacification of the invention ensures: the pinpoint protection of a target, the black-out of an extended group of targets, the reduction of the radiation level of a heat source, particularly the radiation level of the propulsion system of a vehicle.

It is apparent that within the scope of the invention, modifications and different arrangements can be made other than are here disclosed. The present disclosure is merely illustrative with the invention comprehending all variations thereof.

What is claimed is:

1. A process for opacifying a gaseous medium transparent to optical and thermal radiation, consisting in diffusing in the medium a boron trichloride aerosol, at a delivery rate sufficient to attenuate electromagnetic radiations extending from 0.4 to 15 $\mu$m to an extent greater than 90%.

2. The process as claimed in claim 1, wherein said aerosol is stored, in liquid form, in a receptacle comprising means for diffusing said aerosol.

3. The process as claimed in claim 1, wherein said aerosol is stored, in a gaseous form, in a receptacle comprising means for diffusing said aerosol.

4. The process as claimed in claim 1, wherein said gaseous medium is formed by the atmosphere.

5. The process as claimed in claim 1, wherein said gaseous medium is formed by the output flow from a propulsion system.

6. A process for opacifying a gaseous medium transparent to optical and thermal radiation, consisting in diffusing in the medium a boron trichloride aerosol in the presence of sufficient water vapor to hydrolyze the boron trichloride, at a delivery rate sufficient to attenuate electromagnetic radiations extending from 0.4 to 15 μm to an extent greater than 90%.

7. The process as claimed in claim 6, wherein said aerosol and the water from which said water vapor is obtained are stored separately in receptacles and are dispersed conjointly.

* * * * *